US008037572B2

(12) United States Patent
Phelan et al.

(10) Patent No.: US 8,037,572 B2
(45) Date of Patent: Oct. 18, 2011

(54) VACUUM WITH STOWABLE HANDLE

(75) Inventors: Katherine E. Phelan, Towson, MD (US); Kathy E. DiPasquale, Baltimore, MD (US); Stuart J. Wright, Timonium, MD (US); Brian Horigan, Massapequa Park, NY (US)

(73) Assignee: Black & Decker Inc., Newark, DE (US)

( * ) Notice: Subject to any disclaimer, the term of this patent is extended or adjusted under 35 U.S.C. 154(b) by 1041 days.

(21) Appl. No.: 11/870,876

(22) Filed: Oct. 11, 2007

(65) Prior Publication Data

US 2008/0115318 A1 May 22, 2008

Related U.S. Application Data

(60) Provisional application No. 60/859,949, filed on Nov. 20, 2006.

(51) Int. Cl.
*A47L 9/00* (2006.01)

(52) U.S. Cl. ..... 15/410; 15/327.6

(58) Field of Classification Search ..... 15/327.6, 15/314, 410; *A47L 9/00*
See application file for complete search history.

(56) References Cited

U.S. PATENT DOCUMENTS

| | | | | |
|---|---|---|---|---|
| 3,669,463 | A | 6/1972 | Boudreau | |
| 3,930,630 | A | 1/1976 | Wulff | |
| 4,193,161 | A * | 3/1980 | Scott | 15/352 |
| 4,222,145 | A | 9/1980 | Lowder | |
| 4,705,282 | A | 11/1987 | Berfield | |
| 5,979,014 | A | 11/1999 | Reichow et al. | |
| D446,612 | S | 8/2001 | Kohler | |
| 6,378,165 | B1 | 4/2002 | Holsten et al. | |
| D521,700 | S | 5/2006 | Griffin | |
| D528,718 | S | 9/2006 | Tomasiak et al. | |
| 2004/0205928 | A1 | 10/2004 | Alford et al. | |
| 2005/0055794 | A1 | 3/2005 | Marshall et al. | |

FOREIGN PATENT DOCUMENTS

| | | | |
|---|---|---|---|
| EP | 0928525 | A1 | 7/1999 |
| EP | 0935944 | A1 | 8/1999 |
| GB | 608238 | A | 9/1948 |
| GB | 2141328 | A | 12/1984 |

* cited by examiner

*Primary Examiner* — David Redding
(74) *Attorney, Agent, or Firm* — Harness, Dickey & Pierce, P.L.C.

(57) ABSTRACT

A vacuum having a container and a cover coupled to the container. The coupled cover and container define an interior space communicating with an inlet and an outlet. A fan is fluidly disposed between the inlet and the outlet and a motor is operable to rotationally drive the fan, wherein rotation of the fan creates a fluid flow from the inlet, through the interior space, and out the outlet. A frame supports the container and a handle coupled to the frame is moveable between a use position and a stowed position.

18 Claims, 5 Drawing Sheets

VACUUM WITH STOWABLE HANDLE

CROSS-REFERENCE TO RELATED APPLICATIONS

This application claims the benefit of U.S. Provisional Application No. 60/859,949, filed on Nov. 20, 2006. The disclosure of the above provisional application is incorporated herein by reference.

FIELD

The present disclosure relates to a vacuum that may be used in both dry and wet cleaning applications. The vacuum may include a handle that can be extended or retracted.

BACKGROUND

The statements in this section merely provide background information related to the present disclosure and may not constitute prior art.

Conventional wet/dry vacuums often include a frame that supports a collection container, which can receive and trap unwanted materials, like dirt, water, construction waste, etc. The vacuum frame usually includes four wheels, often casters, mounted to the bottom of the frame for allowing the vacuum to be moved, or rolled, about an area without having to lift the vacuum off from a floor surface.

Many vacuums are moved about the floor surface by simply pushing on or pulling on an accessible portion of the vacuum, such as a top cover, to exert a directional force on the vacuum. However, pushing or pulling an accessible portion of the vacuum can be inconvenient and ineffective. For example, the user may have to bend over to apply the directional force. For another example, applying the directional force to an upper surface of the vacuum, like the top cover, may encourage the vacuum to tip over, particularly if moving the vacuum over an uneven or rough flooring surface.

Some vacuums are equipped with a handle to provide a convenient and effective means of transferring the directional force to the vacuum. However, vacuums equipped with such handles have a larger overall size and require additional storage space. The additional storage space need may further make lifting and transporting the vacuum more difficult. Accordingly, it would be advantageous to provide a vacuum having a handle that is moveable between an extended position to conveniently and efficiently roll the vacuum along the floor and a stowed position which reduces an overall size of the vacuum.

SUMMARY

A vacuum according to the principles of the present teachings provides a container and a cover coupled to the container. The coupled cover and container define an interior space communicating with an inlet and an outlet. A fan is fluidly disposed between the inlet and the outlet and a motor is operable to rotationally drive the fan, wherein rotation of the fan creates a fluid flow from the inlet, through the interior space, and out the outlet. A frame supports the container and a handle coupled to the frame is moveable between a first position and a second position.

Also provided is a method of selectively securing a rotatable handle for a container vacuum in an extended position. The method comprises rotating the handle toward the extended position, coupling a latch and a receiver, wherein one of the latch and the receiver is coupled to the rotating handle and the other one of the latch and the receiver is coupled to the vacuum such that said coupled latch and receiver maintain said handle in said extended position.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
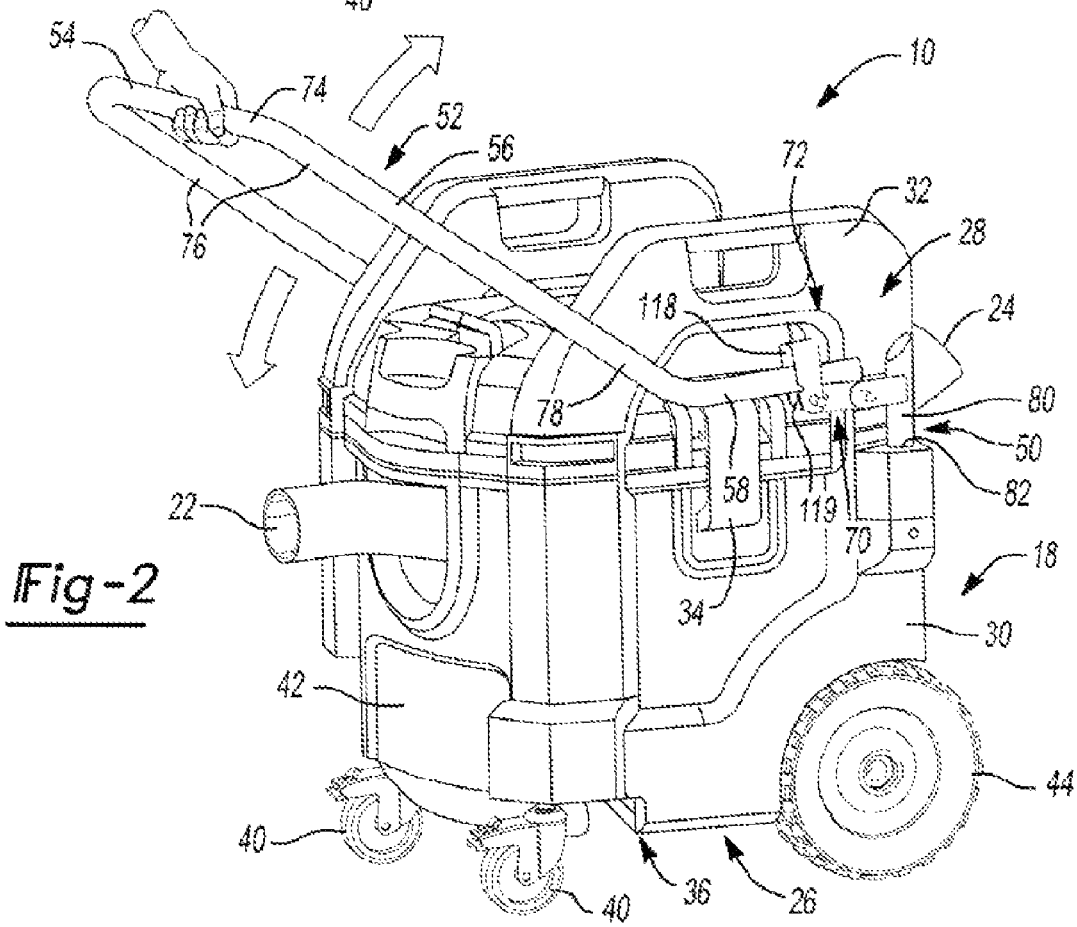
FIG. 2 is a perspective view of a vacuum having a handle assembly in accordance with the present teachings.
Figure 4A:
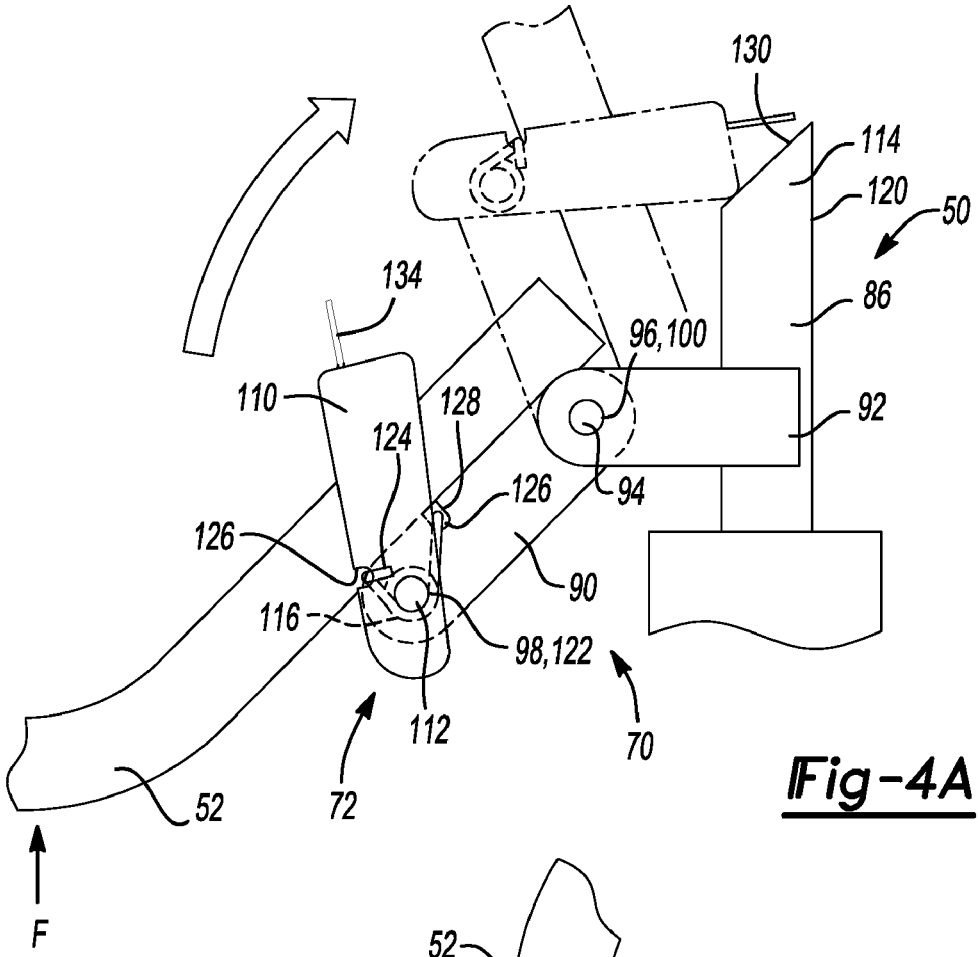
Figure 4B:
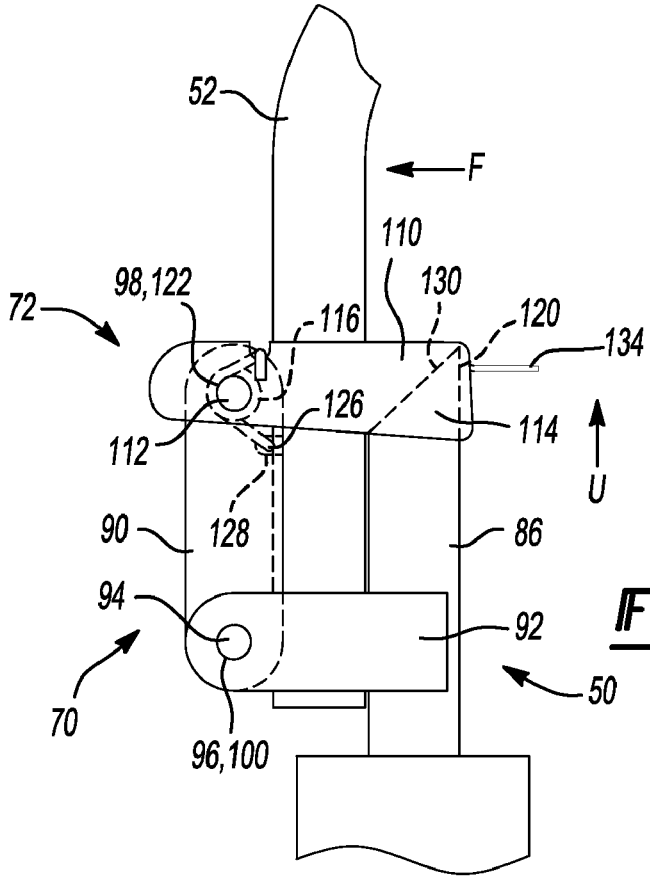
Figure 5:
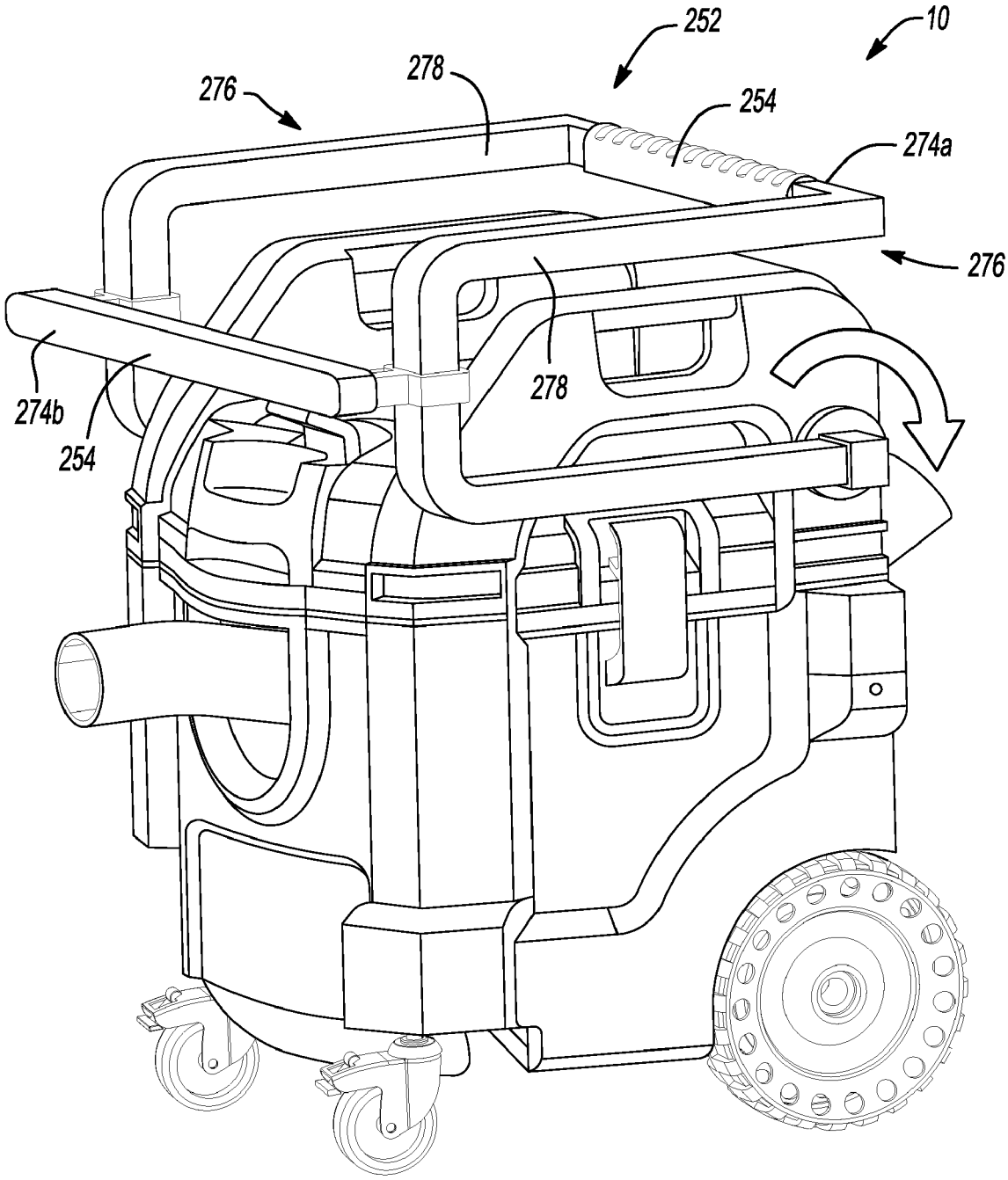
Figure 6:
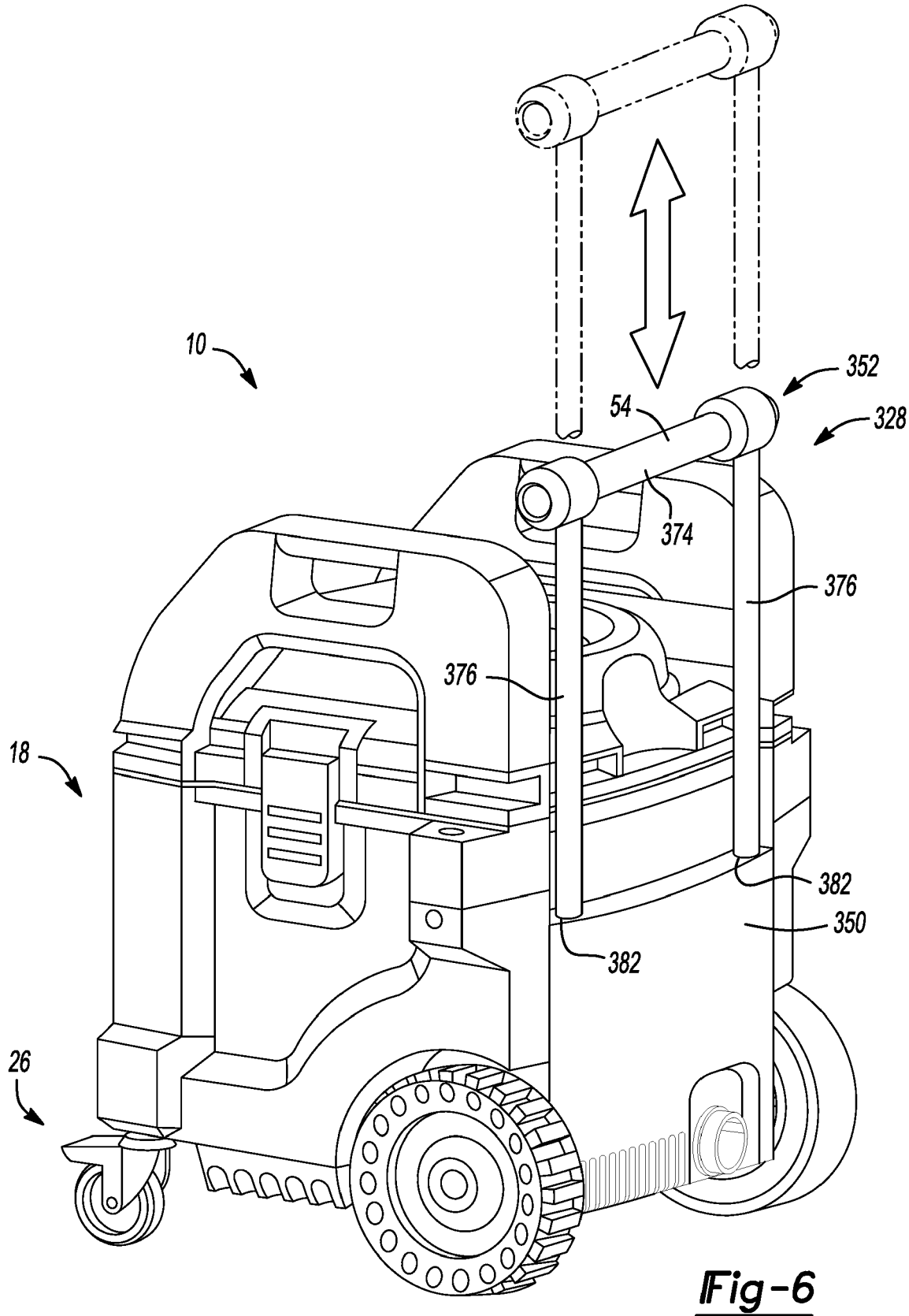

FIG. 4*a* is a magnified partial view of a locking mechanism of the vacuum of FIG. 2;

FIG. 4*b* is a another magnified partial view of the locking mechanism of the vacuum of FIG. 2;

FIG. 5 is a perspective view of a vacuum having an alternative pivoting handle; and FIG. 6 is a perspective view of a vacuum having a retractable slidable handle.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 1:
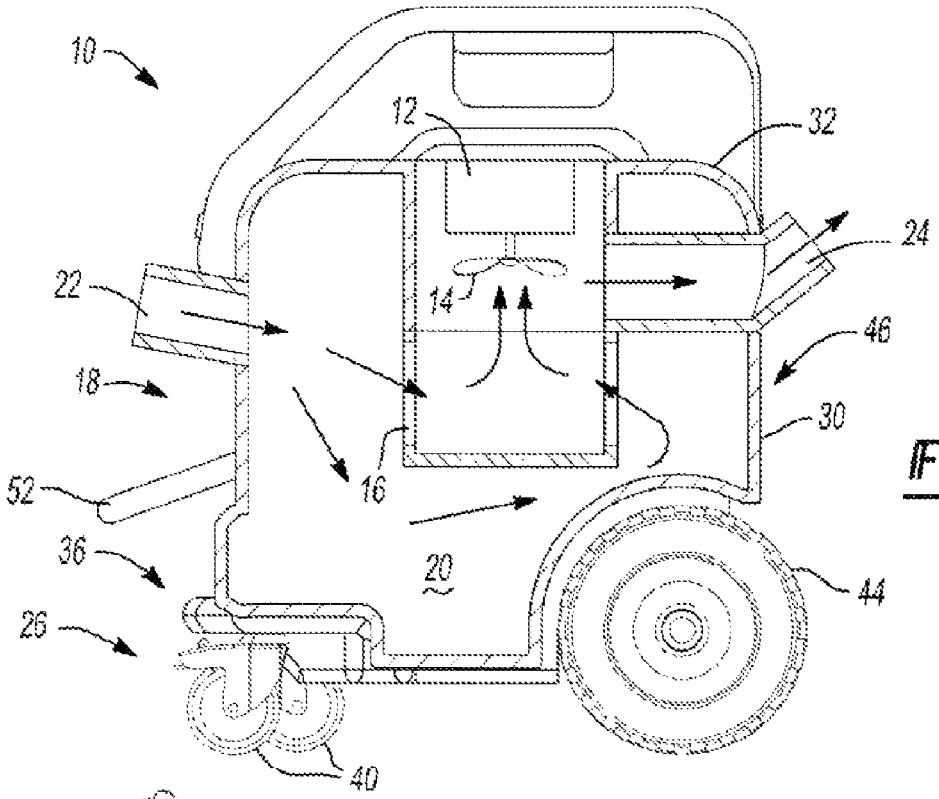
FIG. 1 is a cross-sectional illustration of a container vacuum.

With reference to FIGS. 1 and 2, a vacuum 10 is provided and may include a motor 12, a fan 14, and a filter 16, each supported within a collection container 18 having an interior volume 20 communicating with an inlet 22 and an outlet 24. The fan 14 may be rotationally coupled to the motor 12 and disposed between the inlet 22 and the outlet 24 to draw air into the interior volume 20 of the container 18 through the inlet 22, through the filter 16, and then expel the air through the outlet 24. A wheeled frame 26 may support the vacuum 10 off the ground and provide a means of moving the vacuum 10 from one place to another. A handle assembly 28 attached to the frame 26 or otherwise attached to the vacuum 10 may provide a readily accessible and convenient interface for a user to push or pull the vacuum 10 to a desirable direction.

The collection container 18 may include a cover 32 releasably secured to a canister 30 by a sufficient coupling means 34, such as a xx latch 110 mechanism. The secured cover 32 and canister 30 define the interior volume 20, which is readily accessible by disengaging the coupling means 34 and separating the canister 30 and the cover 32.

The frame 26 may have a frame body 36 integrally formed with the canister 30 and may include four wheels 38. Each wheel 38 may be disposed generally at a corner of the frame body 36 to support the frame body 36 off the ground and provide mobility for the vacuum. In the particular embodiments illustrated, the frame 26 includes a pair of swivelable wheels, or casters 40, disposed on opposite sides of a front portion 42 of the frame 26 and a pair of wheels 44 connected by an axle and disposed on opposite sides of a rear portion 46 of the frame 26. While the frame body 36 illustrated in each of the disclosed embodiments is integrally formed with the canister 30, a person of ordinary skill in the art will appreciate that the frame body 36 could be a separate component that is coupled to the canister 30 or that can otherwise removably receive the canister 30 therein. The person of ordinary skill will further appreciate that different wheel configurations can be utilized. For example, the frame 26 could include more than or less than four wheels (i.e., three-caster and one-caster configurations). For another example, the body could include four casters and no axled wheels. For yet another example, the pair of casters could be disposed at the rear portion 46 of the frame 26 and the pair of axled wheels could be disposed at the front portion 42 of the frame 26.

Figure 3:
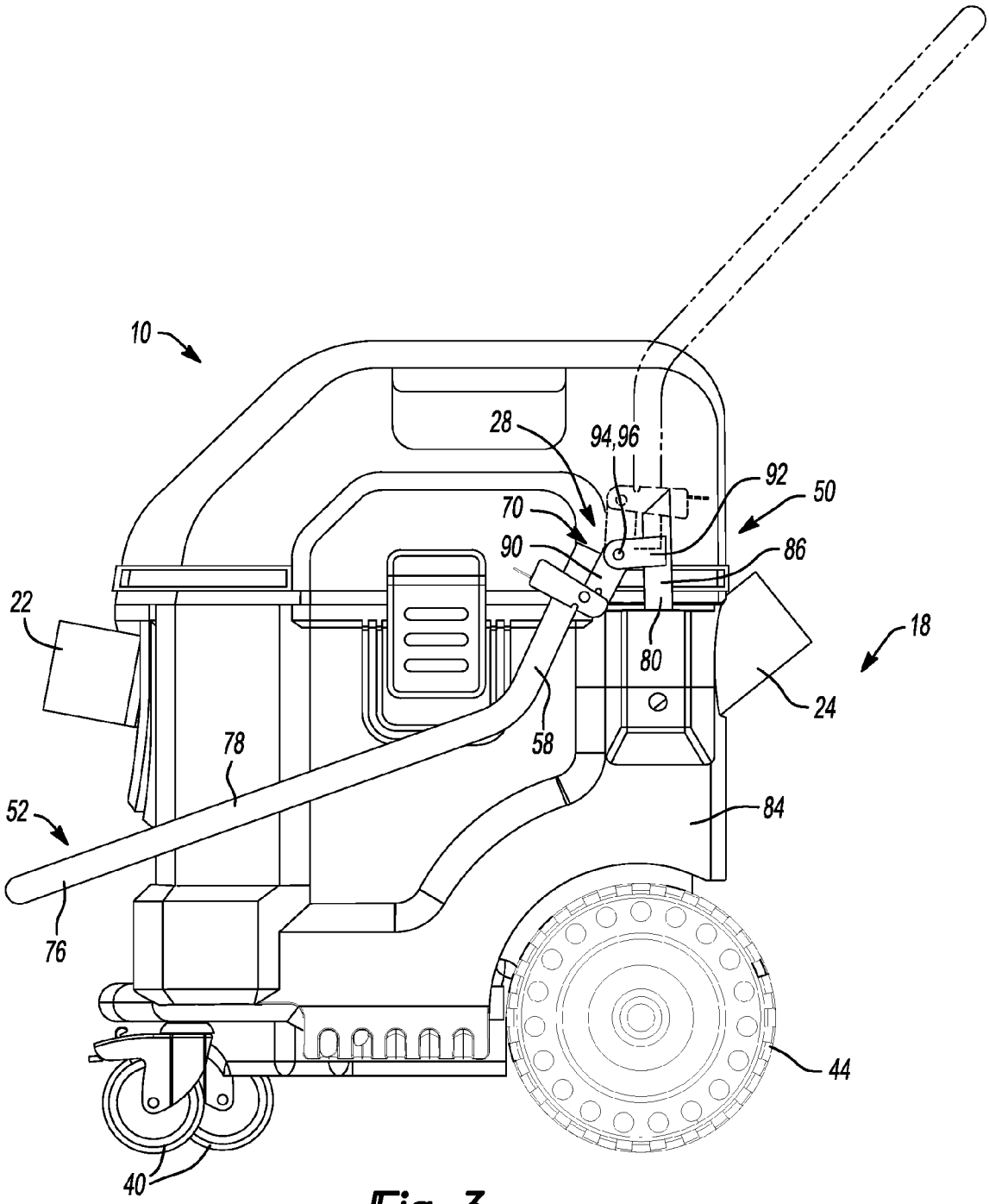
FIG. 3 is a side view of the vacuum of FIG. 2 illustrating various positions of a pivotable handle in accordance with the present teachings.

The handle assembly 28 may include a support member 50 coupled to the collection container 18 or the frame 26 and a handle 52 coupled to the support member 50 and moveable between an extended position (phantom lines in FIG. 3) and a stowed position (solid lines in FIG. 3). The handle 52 may generally include a grip portion 54, an extension portion 56 operable to offset the grip portion 54 from the vacuum 10, and an engagement portion 58 for coupling the handle 52 to the support member 50.

In the extended position, a user may conveniently and easily grasp the extended grip portion 54 to push or pull the vacuum 10 from one area to another area. Alternatively, the user can use the grip portion 54 to pivot the vacuum 10 about the axled wheels 44 and push or pull the vacuum 10 in a manner similar to a dolly. The handle 52 can be moved to the stowed position to reduce an overall size of the vacuum 10, relative to an overall size of the vacuum 10 with the handle 52 in the extended position, such that the vacuum 10 requires less storage space. In the stowed position, the handle 52 may also protect the vacuum 10 from impacts with other objects by preventing the objects from contacting the container 18 or the frame 26.

With specific reference now to FIGS. 2-4, a first embodiment of a handle assembly 28 is illustrated that may pivot between the extended position and the stowed position. The handle assembly 28 may include a handle 52 coupled to a pair of support members 50 by a pair of pivot assemblies 70. A locking mechanism 72 may selectively secure the handle 52 in the extended position and may be disengaged to permit the handle 52 to rotate to the stowed position.

The handle 52 may include a cross-member 74 and a pair of extension arms 76. The handle 52 may be configured to be a generally U-shaped handle 52 by integrally forming the cross-member 74 and extension arms 76 from a single piece of tubing having a desirable cross-sectional shape, such as a square, round, rectangular, or triangular cross-sectional shape. Alternatively, the cross-member 74 and extension arms 76 could be individual components coupled to form the U-shaped handle 52 using any suitable method, such as welding, brazing, or mechanical fasteners. The cross-member 74 provides the grip member portion 54 for convenient user access. Each extension arm 76 can include a generally straight portion 78 coupled to the cross-member 74 on one end and one of a pair of engagement portions 58 on the opposite end. Each engagement portion 58 can extend angularly from a respective extension arm 76. A length of the straight portion 78, a length of the engagement portion 58, and the angle therebetween can each be engineered to create a desirable configuration of the handle assembly 28 such that the grip portion 54 is desirably positioned when in either the stowed or extended positions.

The support member 50 may be a pair of tubular bodies 80 that engage and are secured within apertures 82 formed in an outer portion 84 of the container 18 and disposed on generally opposite sides of the container 18. A support portion 86 of the tubular bodies 80 extends outward from the container 18 for coupling engagement with the handle 52. While not illustrated, the person skilled in the art will appreciate that the support member 50 could, alternatively, engage and be secured to the frame 26. The skilled person will further appreciate that the support member 50 could be integrally formed with either the container 18 or the frame 26.

As best illustrated in FIGS. 4A and 4B, the pivot assembly 70 may include a pair of handle pivot plates 90 fixed to the handle 52 and pivotally coupled by a pivot pin 94 to a pair of support member pivot plates 92 fixed to a respective support member 50. Each handle pivot plate 90 may be a generally flat, rectangularly shaped plate with radiused corners. A first pivot aperture 96 configured to receive the pivot pin 94 may extend through one end of the pivot plate 90 and a second pivot aperture 98 may extend through another end. The pivot plates 90 are spaced-apart and secured to a distal end of a respective engagement arm of the handle 52 such that respective first pivot apertures 96 and respective second pivot apertures 98 are generally axially aligned.

Each support member pivot plate 92 may be a generally flat, rectangular plate with radiused corners on one end. A pivot aperture 100 configured to receive the pivot pin 94 may extend through one end of the pivot plate 92. The pivot plates 92 are spaced-apart and secured to the support portion 86 of a respective support member 50 such that the pivot apertures 100 are generally axially aligned and offset from the support member 50.

The gapped support member pivot plates 92 are positioned to straddle the handle pivot plates 90 such that the apertures 96, 100 are aligned to receive the pivot pin 94. The pivot pin 94 may be a threaded fastener extending through the apertures and secured by a nut to pivotally secure the handle assembly 28 to the support member 50. The person of ordinary skill in the art will appreciate, however, that the pivot pin 94 could be a generally permanent pivot pin, such as a roll pin or dowel pin, or could be a readily removable pivot pin, such as a quick release pin. Secured in one of these manners, the handle 52 may be factory installed to provide convenience to the consumer or may be removable to provide convenience for packaging and shipping.

The locking mechanism 72 may include a latch 110 pivotally coupled to the handle pivot plates 90 by a pivot pin 112 and engageable with a receiver 114. A spring 116, such as a torsion spring, may bias the latch 110 toward engagement with the receiver 114. The latch 110 may be generally U-shaped and have an engagement aperture 118 disposed generally near a closed end of the latch 110. The engagement aperture 118 may be configured to compliment an exterior shape 120 of the receiver 114 for engagement therewith. Axially-aligned apertures 122 configured to receive the pivot pin 112 may extend through the latch 110 near an open end of the latch 110. A gap 119 between parallelly extending portions of the latch 110 is configured to straddle the handle pivot plates 90 such that apertures 98, 122 are aligned to receive the pivot pin 112.

The pivot pin 112 may extend through the apertures 98, 122 to pivotally secure the latch 110 to the handle pivot plates 90 wherein the engagement portion 79 of the handle 52 is disposed within the engagement aperture 118. The pivot pin 112 supports the torsion spring 116 in the gap 119, and a first distal end 124 of the spring 116 is secured in a slot 126 formed in the latch 110 and a second distal end 126 is secured in a slot 128 formed in one of the handle pivot plates 90. Secured in this manner, the torsion spring 116 biases the latch 110 back toward a locked position in which the latch 110 extends generally perpendicularly to the engagement portion 79.

The receiver 114 may be integrally formed with the support member 50 and may include a bearing surface 130. The bearing surface 130 is angled relative to a bottom portion 132 of the latch 110 in the locked position and positioned such that the latch 110 can communicate with the bearing surface 130 as the handle 52 rotates toward the extended position.

With reference now to FIGS. 1-4B, operation of the locking mechanism 72 and the handle assembly 28 will now be described in greater detail. Starting with the configuration illustrated in FIG. 4*a*, wherein the handle 52 is in the stowed position and the locking mechanism 72 is in the locked position. A force F exerted on the handle 52, particularly the grip portion 54, may rotate the handle 52 about the pivot pin 94 toward the extended position until the latch 110 contacts the bearing surface 130. The bearing surface 130 exerts a rotational force on the latch 110 sufficient to overcome the bias of the torsion spring 116 such that continued rotation of the handle 52 toward the upright position causes the latch 110 to rotate about pivot pin 112 and slide up the angled bearing surface 130. When the latch 110 disengages the bearing surface 130, at which point the rotational force exerted on the latch 110 by the bearing surface 130 is removed, the torsion spring 116 biases the latch 110 into the locked position, as illustrated in FIG. 4*b*. The interior surface 118 of the latch 110 engages the receiver 114 and maintains the handle 52 in the extended position.

To return the handle 52 to the stowed position, an upward axial force U (as shown in FIG. 4B) exerted on a tab 134 protruding from the latch 110 may overcome the bias exerted by the torsion spring 116 and rotate the latch 110 such that the interior surface of the latch 110 disengages from the receiver 114. A subsequent or simultaneous force F exerted on the handle 52 may rotate the handle 52 away from the receiver 114 and permit the torsion spring 116 to bias the latch 110 back toward the locked position. However, the latch 110 does not engage the receiver 114, as the handle 52 is rotated toward the stowed position.

With specific reference now to FIG. 5, another embodiment of a pivotable handle 252 is shown having a pair of extension arms 276 and first and second cross-members 274*a*, 274*b* coupled therebetween to maintain the extension arms in a spaced apart relationship. The cross-members 274*a*, 274*b* may define the grip portion 254 for convenient user access. Each extension arm 276 includes a generally J- or U-shaped extension portion 278 coupled to the first cross-member 274*a* on one end and the vacuum 10 on an opposite end. Opposite ends of the second cross-member 274*b* can be coupled to respective extension portions 278 to provide a second grip portion 54. While not illustrated, the handle 252 may be coupled to the vacuum 10 in accordance with the previous teachings.

With specific reference now to FIG. 6, a retractable slidable handle assembly 328 is provided having a handle 352 slidably coupled to a support member 350. Although not shown, additional features, such as a stop mechanism and a locking device, may be provided for additional convenience and functionality.

The handle 352 may include a cross-member 374 and a pair of extension arms 376. The cross-member 374 and the extension arms 376 may be integrally formed into a generally U-shaped handle 352 from a single piece of tubing having a desirable cross-sectional shape, such as a square, round, rectangular, or triangular cross-sectional shape. The cross-member 374 may define the grip portion 54 for convenient user access. Alternatively, the cross-member and extension arms could be individual components coupled using any suitable method, such as welding, brazing, or mechanical fasteners, to form the U-shaped handle 352.

The support member 350 may be coupled to the container 18 and may include apertures 382 extending therethrough. The apertures 382 may be configured to compliment and receive a respective extension arm 376. The person of ordinary skill will appreciate that the support member 350 may be integrally formed with the container 18 and, further, that the support member 350 may be coupled to and integrally formed with the frame 26. While this embodiment discloses a pair of single tubes sliding in respective apertures of the support member, the person of ordinary skill will also appreciate that the handle assembly 328 could include one or more intermediate sliding tubes arranged in a telescoping configuration.

The stop mechanism may prevent the handle 352 from disengaging the support member 350 when the handle 352 is moved to the extended position. For example, the stop mechanism could be a conventional stop sleeve coupled to one or both of the handle 352 and the support member 350.

The locking device may be a conventional locking device operable to lock the handle 352 to the support member 350 when the handle 352 is in the extended position or at one of a plurality of positions between the stowed position and the extended position. For example, the locking device could be a conventional ball detent assembly coupled to the handle 352 or the support member 350 that engages a plurality of mating holes disposed in the other of the handle 352 or the support member 350. For another example, the locking device could be a button activated locking device with the activation button mounted on the handle 352 or the support member 350.

While specific configurations of the handle assembly and the handle have been disclosed, the person of ordinary skill will appreciate that various handle assembly configurations and handle configurations fall within spirit of the present teachings. For example, the handle could have a shape other than a U-shape or J-shape, such as T-shape or t-shape. For another example, the handle assembly could utilize an alternatively shaped handle having a single distal end coupled to a single support member.

What is claimed is:

1. A vacuum comprising:

a housing including a collection canister and a cover coupled to said canister, said cover and said canister defining an interior space;

an inlet and an outlet, said inlet and outlet communicating with said interior space;

a fan in fluid communication with said inlet and said outlet;

a motor operable to rotationally drive said fan wherein rotation of said fan creates a fluid flow from said inlet, through said interior space, and out said outlet;

a handle coupled to said housing and movable between a first position and a second position; and a locking mechanism associated with said handle and including a latch and a receiver, said receiver being fixed relative to said collection canister when said handle is moved between said first and second positions, said latch being moveable between a locked position restricting movement of said handle relative to said housing and an unlocked position allowing movement of said handle relative to said housing, said latch engaging said receiver in said locked position, wherein movement of said locking mechanism between said locked and unlocked positions includes relative pivotal movement between said latch and said receiver that is independent of movement of said handle between said first and second positions.

2. The vacuum of claim 1, wherein said handle is rotatable relative to said housing between said first position and said second position.

3. The vacuum of claim 2, wherein said handle is a tubular handle.

4. The vacuum of claim 1, further comprising a support member coupled to said housing, said handle being pivotably coupled to said support member.

5. The vacuum of claim 1, further comprising a pair of spaced-apart support members coupled to said housing, each of said support members are pivotably coupled to a respective one of a pair of spaced-apart ends of said handle.

6. The vacuum of claim 1, wherein said latch is pivotally coupled to said handle and includes an engagement aperture extending therethrough.

7. The handle assembly of claim 6, wherein said receiver is fixed relative to said housing.

8. The vacuum of claim 6, wherein said engagement aperture in said latch is operable to engage said receiver when said latch is in said locked position.

9. The vacuum of claim 1, wherein said locking mechanism further includes a biasing member urging said latch toward said locked position.

10. The vacuum of claim 9, wherein said biasing member is a torsion spring having a first end coupled to said latch and a second end coupled to said handle.

11. The vacuum of claim 1, wherein said receiver includes a bearing surface operable to communicate with said latch and bias said latch toward said unlocked position when said handle rotates toward one of said first position and said second position.

12. The vacuum of claim 4, wherein said receiver is integrally formed with said support member.

13. A method of rotating and selectively securing a handle for a wet/dry vacuum in an extended position, said method comprising:

rotating the handle toward the extended position;

coupling a latch and a receiver, wherein one of said latch and said receiver is coupled to said rotating handle and the other one of said latch and said receiver is coupled to the vacuum such that said coupled latch and receiver maintain said handle in said extended position, wherein coupling said latch and said receiver includes relative pivotal movement between said latch and said receiver that is independent of rotation of the handle toward the extended position further comprising uncoupling said coupled latch and receiver and rotating said handle away from said extended position, wherein a spring biases said latch into said locked position.

14. The method of claim 13, wherein coupling said latch and said receiver includes rotating said latch to an unlocked position and further rotating said handle to said extended position.

15. A method of rotating and selectively securing a handle for a wet/dry vacuum in an extended position, said method comprising:

rotating the handle toward the extended position;

coupling a latch and a receiver, wherein one of said latch and said receiver is coupled to said rotating handle and the other one of said latch and said receiver is coupled to the vacuum such that said coupled latch and receiver maintain said handle in said extended position, wherein coupling said latch and said receiver includes relative pivotal movement between said latch and said receiver that is independent of rotation of the handle toward the extended position, wherein rotating said latch to said unlocked position includes rotating said handle toward said extended position until said latch communicates with said receiver such that said receiver urges said latch toward said unlocked position.

16. The method of claim 15, wherein rotating said latch to said unlocked position further includes biasing said latch toward a locked position.

17. The method of claim 13, wherein uncoupling said coupled latch and receiver includes rotating said latch to an unlocked position.

18. The method of claim 13, wherein rotating said handle away from said extended position includes rotating said latch to said locked position.

* * * * *